US005394725A

United States Patent [19]

Lisec

[11] Patent Number: 5,394,725

[45] Date of Patent: Mar. 7, 1995

[54] APPARATUS FOR THE PRODUCTION OF SPACER FRAMES FOR INSULATING GLASS PANES FROM HOLLOW PROFILE STRIPS

[76] Inventor: Pater Lisec, Bahnhofstrasse 34, A-3363 Amstetten-Hausmening, Austria

[21] Appl. No.: 92,479

[22] Filed: Jul. 16, 1993

[30] Foreign Application Priority Data

Jul. 16, 1992 [AT] Austria ..... 1459/92
Jul. 16, 1992 [AT] Austria ..... 1461/92

[51] Int. Cl.[6] ..... B21D 7/00; B21D 53/74

[52] U.S. Cl. ..... 72/294; 72/307; 29/33 B; 29/33 K; 228/5.7

[58] Field of Search ..... 72/306, 424, 149, 217, 72/387, 294; 29/33 B, 33 K, 33 Q; 228/5.7

[56] References Cited

U.S. PATENT DOCUMENTS 4,885,926 12/1989 Lisec ..... 72/306
5,182,932 2/1993 Ritter ..... 72/306

FOREIGN PATENT DOCUMENTS

1494/88 6/1990 Austria .
0192921 9/1986 European Pat. Off. .
0291499 11/1988 European Pat. Off. .
0419441 3/1991 European Pat. Off. .
432468 6/1991 European Pat. Off. ..... 72/306
0479220 4/1992 European Pat. Off. ..... 72/306
3223881 7/1983 Germany .
3221986 12/1983 Germany .
227896 10/1985 Germany .
87057964 7/1987 Germany ..... 72/306
8904154.2 7/1989 Germany ..... 72/306
3935545 3/1991 Germany ..... 72/306
4109549 10/1991 Germany .
4116521 11/1991 Germany .

OTHER PUBLICATIONS

Lenhardt Macshinenbau GmbH, "Lenhardt—Profilmat 1", Apr. 10, 1992, 8 pages.

*Primary Examiner*—Daniel C. Crane
*Attorney, Agent, or Firm*—Young & Thompson

[57] ABSTRACT

An apparatus for bending hollow profile strips into spacer frames for insulating glass panes, comprises an inclined supporting wall 1, at the bottom rim 8 of which at least one bending head 2 is arranged. A conveyor track 20 feds hollow profile strips to be bent into spacer frames. A device 40 transfers the hollow profile strips from the conveyor track 20 into supports 7 in the zone of the bottom rim 8 of the supporting wall 1. This assembly is provided behind the supporting wall 1. Thereby, the space behind the supporting wall 1 is utilized and the front side of the apparatus remains vacant so that it is accessible for an operator without any danger, and mounting space is saved.

27 Claims, 5 Drawing Sheets

Figure 1:
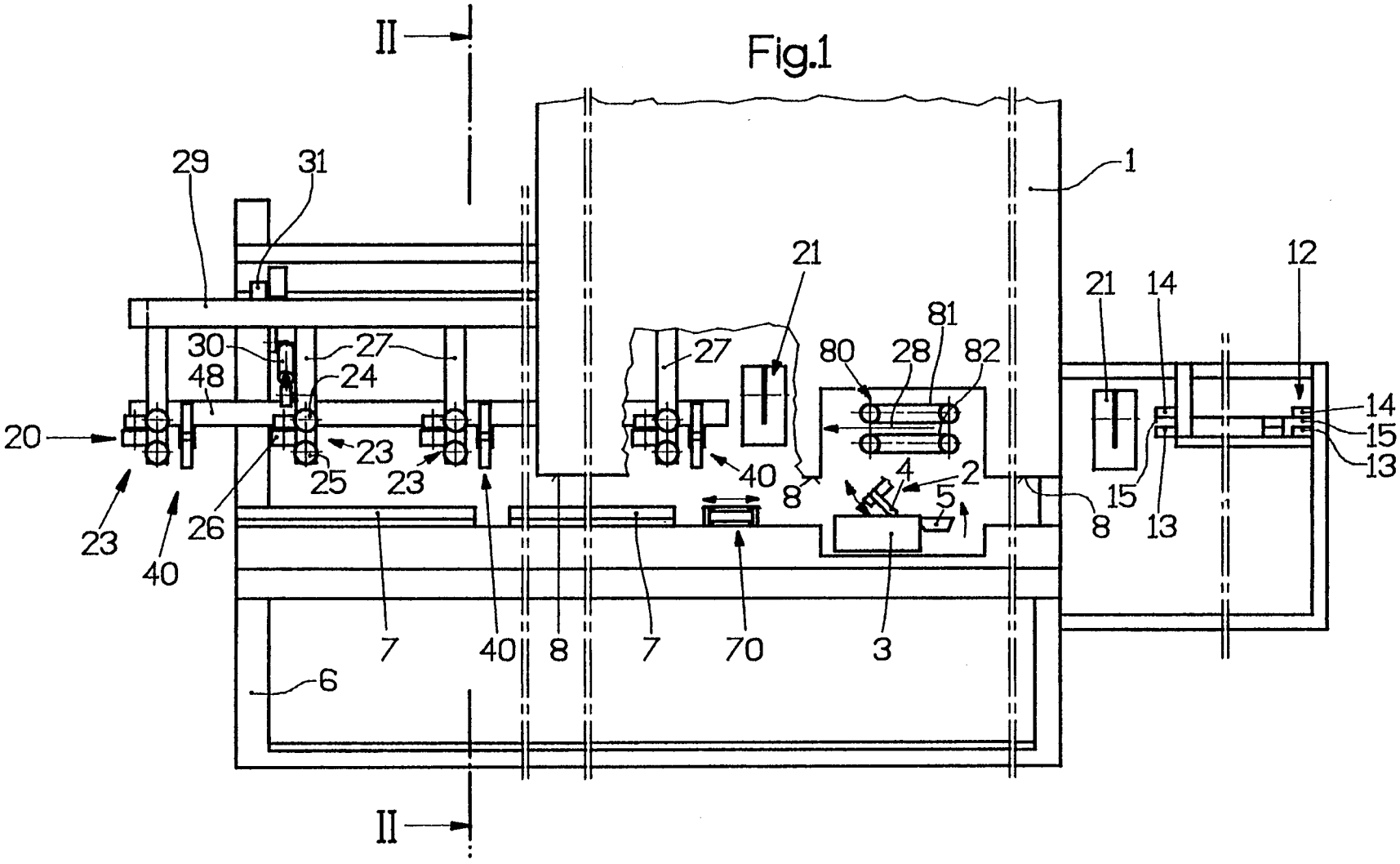

1
2
3
4
5
6
7
8
12
13
14
15
20
21
23
24
25
26
27
28
29
30
31
40
48
70
80
81
82
II
II

APPARATUS FOR THE PRODUCTION OF SPACER FRAMES FOR INSULATING GLASS PANES FROM HOLLOW PROFILE STRIPS

The invention relates to an apparatus for the production of spacer frames for insulating glass panes from hollow profile strips.

In a conventional apparatus of this type, the hollow profile strips to be bent into spacer frames for insulating glass panes are fed along a conveyor track arranged at the upper rim of a plate, sloping obliquely downwardly from the bending heads, on which the bent legs of the hollow strip are resting. Such an apparatus has been known from DE-A-3,223,881. Similar devices for bending rod material are disclosed in EP-A-47 92 20 and in DD-A-227,896.

It is also conventional in such devices to provide a gripper seizing the supplied hollow profile strips, lifting them off the conveyor track at the upper rim of the plate, and inserting them in the bending heads, wherein the hollow profile strip is then retained in the zone between the bending heads by a clamp provided at that location. Such an apparatus is known from EP-A-291,499.

In so-called vertical bending machines, i.e. devices for bending hollow profile strips into spacer frames for insulating glass panes (compare DE-U-87 05 796) wherein the conveyor track is located at the lower end of a supporting wall for the bent legs of the hollow profile strips, this wall ascending obliquely upwardly, it is also known to insert the hollow profile strips from the operating side, i.e. from the front by means of a gripper device. Such an apparatus has been known from published Austrian Patent Application 1494/88 (publication date Jun. 15, 1990).

A similar apparatus has been known from the prospectus of LENHARDT MASCHINENBAUGMBH, "LENHARDT-Profilmat 1". In this conventional apparatus the hollow profile strips are fed to a magazine located upstream of the bending machine and are transferred therefrom individually, by several grippers seizing the hollow profile strips from above, to the bottom rim of the supporting wall and are inserted in the bending heads.

The conventional devices wherein the hollow profile strips are fed from the side, i.e. transversely to their longitudinal extension and are inserted from the front in the bending machine exhibit the drawback that they occupy a large amount of space since the space in front of the bending machine is occupied by the inserting device with its grippers so that the actual bending device is not readily accessible, and the bending step can be observed and controlled only from a relatively large distance. Furthermore, the conventional devices wherein hollow profile strips are fed from the front, i.e. from the operating side, into the bending device have the disadvantage that there is an increased safety risk for the operator on account of the moving grippers.

The invention is based on the object of indicating an apparatus of the type discussed hereinabove wherein the actually existing advantages of inserting hollow profile strips in the bending device transversely to their longitudinal extension are exploited without incurring the above-described disadvantages.

This object has been attained according to the invention, in an apparatus having the features of the introductory portion of claim 1, by imparting to this apparatus the features of claim 1.

In the bending device of this invention, the hollow profile strips are fed, for example, from a magazine located beside the bending device on a conveyor track provided behind the obliquely upwardly pointing supporting wall, this conveyor track being arranged, for example, approximately at the level of the bottom rim of the supporting wall. Insofar as the hollow profile strips do not initially exhibit the correct length, they are cut to the right length after they are located in their entirety on the conveyor track. Hollow profile strips that are too short can be lengthened by welding together or by connecting hollow profile strips with the aid of linear connectors inserted in the hollow profile strips in the zone of the adjoining ends, can then be pushed onto the conveyor track, and can optionally be subsequently cut to size. From the conveyor track, the hollow profile strips are withdrawn by the transfer device and placed into the supports lying in opposition to the bottom rim of the supporting wall.

In a simple embodiment, the support for the hollow profile strip is formed by a plurality of angled supports with a leg aligned in parallel to the plane of the supporting wall and with another leg projecting upwardly perpendicularly thereto. In this way, the hollow profile strips can be readily inserted in the supports by the transfer device, the strips moving past the supporting wall below the bottom rim thereof.

The hollow profile strip lying in the support is then moved by means of a conveying device, e.g. a feeding gripper as known per se from DE-OS 4,109,549, into a zero position defined, for example, by a stop, and thereafter is advanced and bent in correspondence with the desired shape and size of the spacer frame to be produced in accordance with the insulating glass pane for which the spacer frame is intended. In this connection, it is readily possible, using embodiments of the apparatus of this invention, to bend quadrangular (square or rectangular), triangular, or other polygonal spacer frames, or also to manufacture spacer frames bent into a circle or having a peripheral configuration composed of circular arcs and angled bends, as known per se from DE-OS 4,116,521.

The apparatus of this invention has the advantage that the conveyor track for feeding the hollow profile strips and the device for transferring the hollow profile strips from the conveyor track to the supports in opposition to the bottom rim of the supporting wall are located behind the supporting wall and exploit the actually vacant, unused space below the supporting wall so that the operating side of the apparatus is freely accessible; consequently, the observation of the bending or curving steps is not impeded thereby, and in addition there is no safety risk for the operator.

Preferred and advantageous embodiments of the apparatus according to this invention are set forth in the dependent claims.

Figure 2:
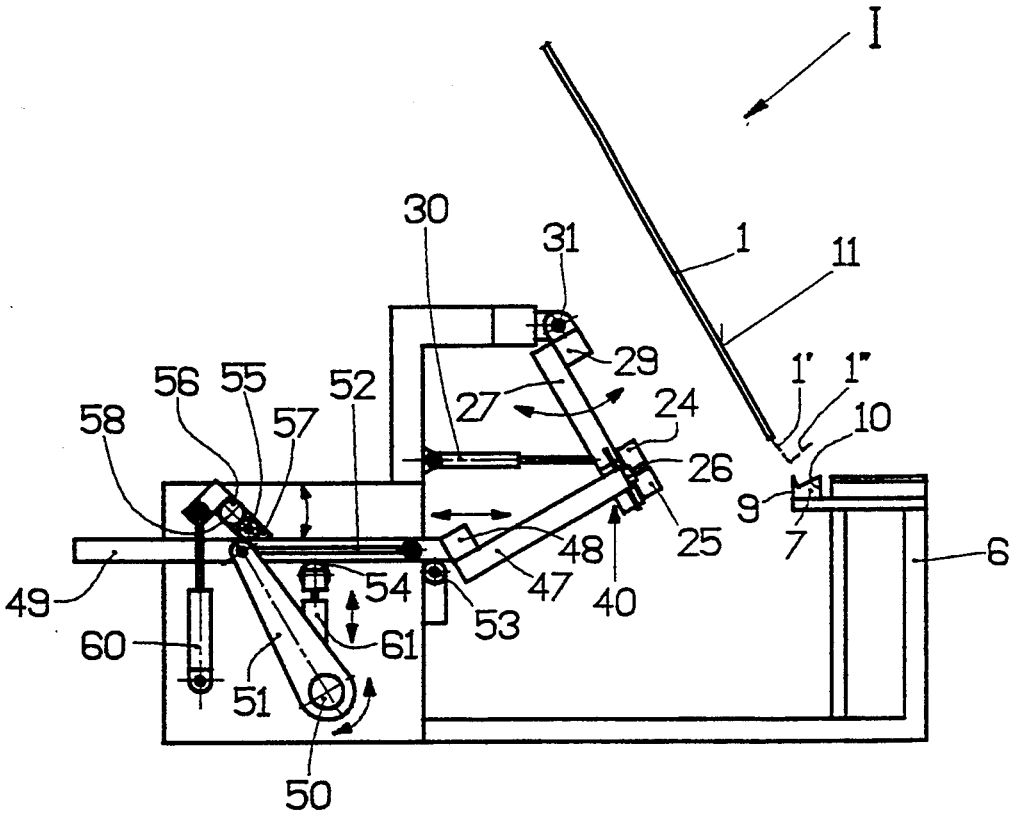
Figure 3:
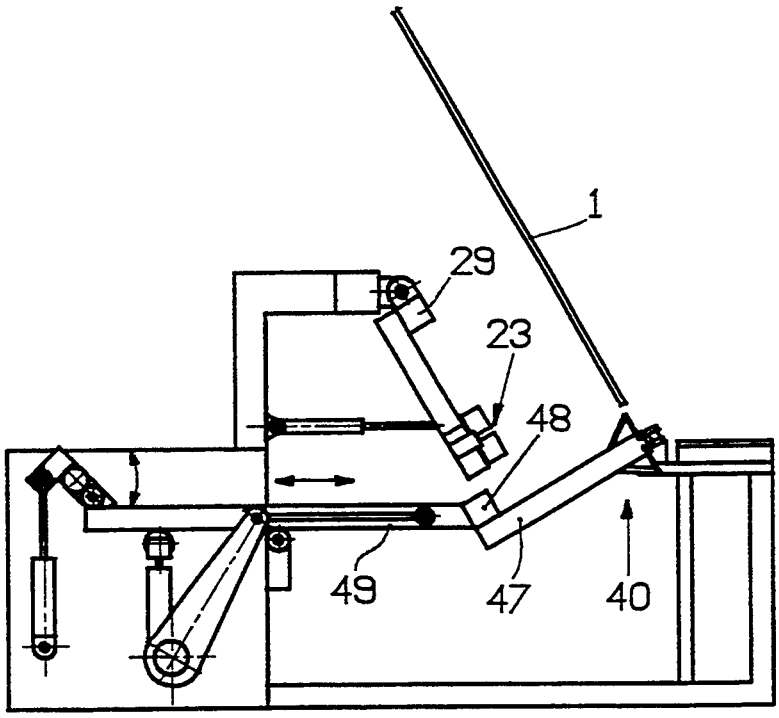
Figure 4:
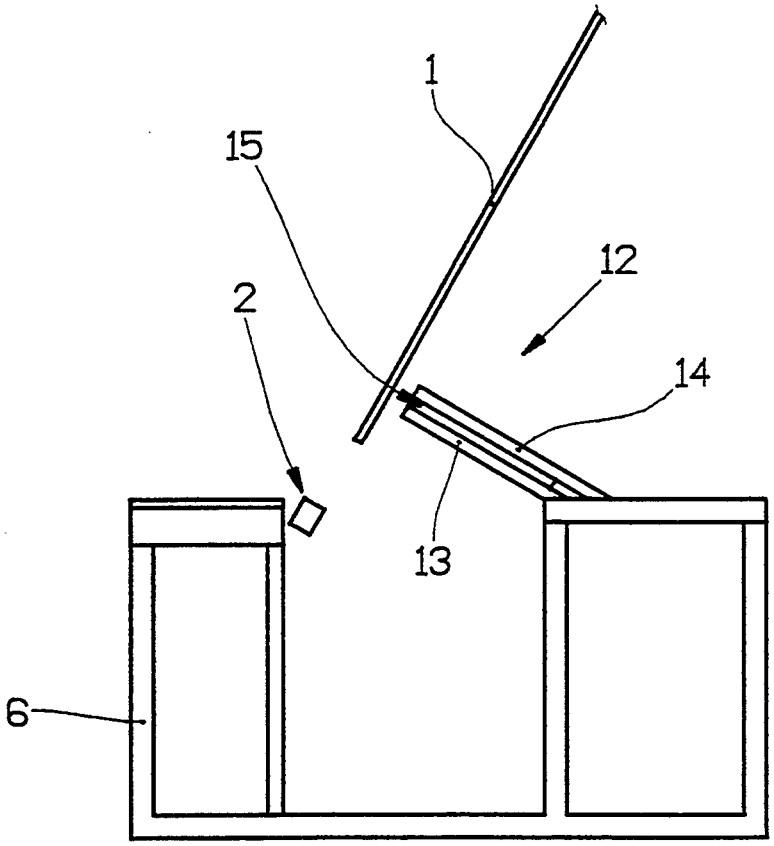
Figure 5:
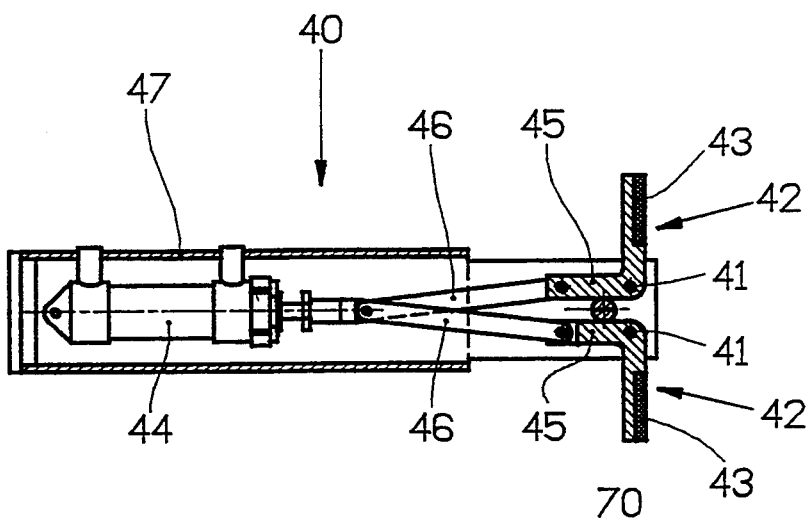
Figure 6:
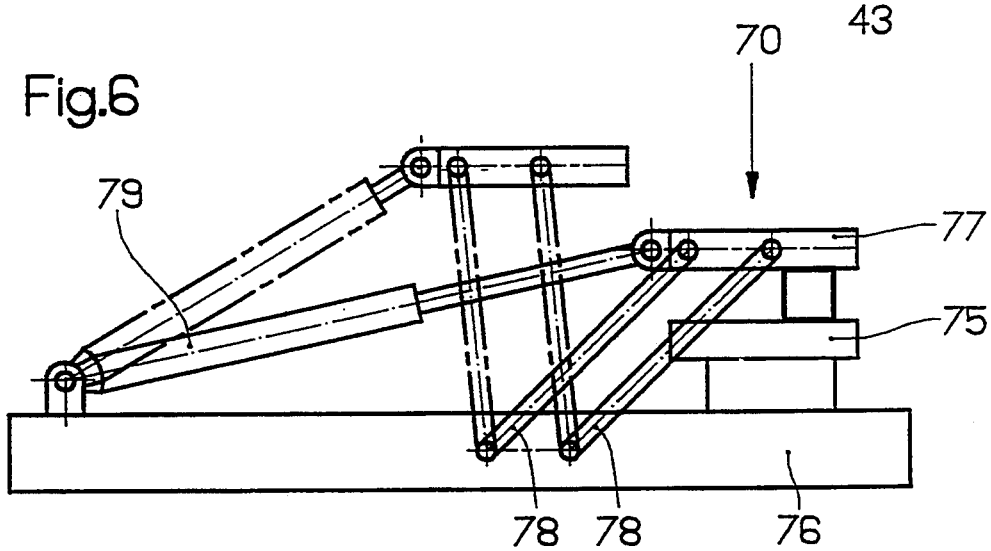
Figure 7:
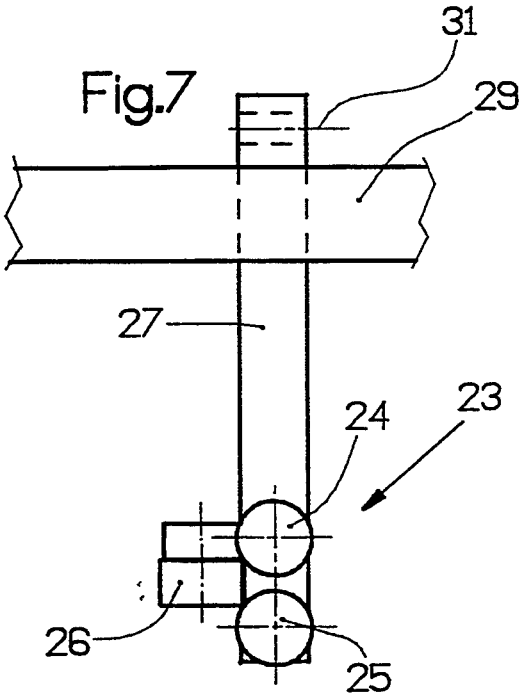
Figure 8:
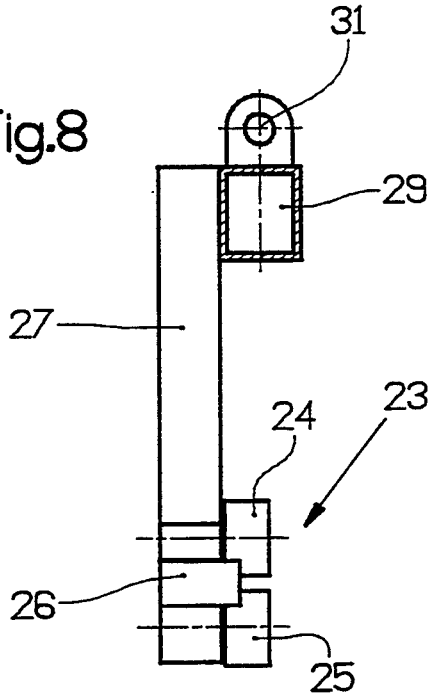

Additional details and features of the apparatus according to the invention can be derived from the following description of the preferred embodiment, illustrated in the drawings, of an apparatus of this invention for bending hollow profile strips into spacer frames for insulating glass panes. In the drawings:

FIG. 1 shows a view of an apparatus for bending spacer frames in the direction of arrow l in FIG. 2, FIG. 2 shows a section through the apparatus of FIG. 1 along line ll—ll, FIG. 3 shows a view of the apparatus corresponding to FIG. 2 but in a different operating position, FIG. 4 shows a schematic illustration of the apparatus of FIG. 1 in a lateral view from the right-hand side of FIG. 1, FIG. 5 shows a clamp of the gripper for transferring hollow profile strips, FIG. 6 shows a feeding gripper for hollow profile strips, FIG. 7 shows a detail of the conveyor track for hollow profile strips, and FIG. 8 shows the detail of FIG. 7 in a lateral view.

The apparatus of this invention comprises a supporting wall 1 ascending obliquely toward the rear in the upward direction, i.e. being inclined away from the operating side; in the illustrated example, a bending head 2 is provided at the bottom rim 8 of this wall. The bending head 2 can be designed as known from DE-OS 4,116,521, this design being suitable, for example, for producing angular bends (corners) of the hollow profile strip and curved sections in hollow profile strips, wherein the angular bends can be rectangular bends of the hollow profile strips or bends at arbitrary angles. For this purpose, the bending head 2 comprises, besides jaws 3 between which the hollow profile strip is guided and retained during the bending step or is guided during the curve-producing step, a bending abutment 4 which can be swung inwards and a bending lever 5 of the structure known from DE-OS 4,116,521. In case curved spacer frame sections are to be produced, the bending lever 5 is oriented obliquely in correspondence with the desired radius of curvature, and the hollow profile strip is deflected from the conveying direction by way of the obliquely positioned bending lever 5 so that the strip assumes a constant curvature during the feeding step, i.e. is bent into the shape of a circular arc. This is likewise known per se from DE-OS 4,116,521.

In opposition to thee bottom rim of the supporting wall 1, angled supports 7 for the hollow profile strip to be bent are provided which are attached to the machine frame 6. The hollow profile strip to be bent is inserted in these supports as will be described below. During this step, the hollow profile strip is placed, from a readiness position wherein it rests on a conveyor track 20 behind the supporting wall 1, into the supports 7, moving past underneath the bottom rim 8 of this wall. The angled supports 7 comprise a leg 9 with a bearing surface lying in the plane 11 of the supporting wall 1 and a leg 10 with a contact surface perpendicular to the supporting wall 1 and pointing obliquely upwardly.

Besides the bending machine proper, a magazine 12 for hollow profile strips is provided in the illustrated embodiment of the apparatus according to this invention. This magazine consists of several slats 13, 14 aligned perpendicularly to the supporting wall 1 and forming respectively between them a compartment 15 for receiving a stack of hollow profile strips. The respectively lowermost hollow profile strip is taken from the stack of hollow profile strips located in the compartment 15 between the slats 13 and 14 and is pushed by means of a transporting device onto the conveyor track 20 extending behind the supporting wall 1 and past the side of the supporting wall 1 lying in opposition to the magazine 12. At the end on the magazine side, i.e. based on the direction symbolized by an arrow 28 in which the hollow profile strips are pushed onto the conveyor track 20 at the beginning of this conveyor track 20, an undercut swing saw 21 is arranged for cutting the hollow profile strips to the length required for producing the respectively desired spacer frame. The Oscillating saw 21 is arranged, in the viewing direction perpendicularly to the bottom rim 8 of the supporting wall 1, between the bending head 2 and the beginning of the conveyor track 20.

In accordance with the illustrated embodiment, a path measuring device 80 is arranged upstream of the undercut swing saw 21; this device is in the form of two revolving endless belts 81, 82 or the like, between which the hollow profile strip passes through under frictional contact. This path measuring device 80 determines the length of a hollow profile strip to be bent and thus the point at which the undercut swing saw 21 must saw off the thus-fed hollow profile strip. The path measuring device 80 can simultaneously serve also as the feeding means for the hollow profile strip. The path measuring device 80 is equipped with an increment pickup which latter is coupled with one of the belts or with a guide wheel or, in case the path measuring device 80 serves simultaneously as the drive means for feeding hollow profile strips to the conveyor track 20, with the drive motor for the belts 81, 82. The increment pickup can comprise, for example, a pinion meshing with the teeth of one of the belts 81 or 82, if the latter are toothed belts.

Furthermore, a device 21 is arranged at the delivery side of the magazine 12, by means of which the hollow profile strips can be joined into longer sections. This device can be a welding unit of the structure known from EP-A-192,921, or it can be a contrivance with which the hollow profile strips can be connected to form longer sections with the aid of linear connectors inserted in the ends of hollow profile strips to be joined together.

The conveyor track 20 for hollow profile strips is constituted in the illustrated embodiment by a series of groups 23 of respectively three rollers 24, 25, 26 freely rotatably supported on arms 27. In this arrangement, two rollers 24, 25 are freely rotatable about axes perpendicular to the supporting wall 1 for the lateral guidance of the thus-fed hollow profile strip, and one roller 26 is freely rotatably supported about an axis in parallel to the plane 11 of the supporting wall 1 for supporting the hollow profile strip in the downward direction. The arms 27, each carrying respectively one group 23 of three rollers 24, 25, 26, the axes of rotation of which are aligned perpendicularly to the conveying direction (arrow 28), are mounted at mutual spacings to a joint beam 29. The beam 29, in turn, is pivotable with the aid of at least one piston-cylinder unit 30 in the machine frame 6 about an axle 31 in parallel to the conveying direction (arrow 28) so that the groups 23 of rollers 24, 25, 26 forming the conveyor track 20 can be lowered out of the path of movement wherein the hollow profile strips are pushed from the magazine 12 onto the conveyor track 20.

The groups 23 of rollers 24, 25, 26 thus form jointly the conveyor track 20 for hollow profile strips, this track being located behind the supporting wall 1 and being open toward this wall, i.e. obliquely in the upward direction.

For removing a hollow profile strip from the conveyor track 20 and for transferring the hollow profile strip into the supports 7, a transfer device with grippers 40 is provided. Each gripper 40 has two gripper jaws 42 with linings 43 of an elastic material, these jaws being swingable about axles 41 oriented in parallel to the conveying direction (arrow 28). With the aid of piston-cylinder units 44 and push arms 46 articulated to extensions 45 of the gripper jaws 42, the latter can be swung from their open position (FIGS. 2 and 5) into the closed position wherein they seize a hollow profile strip (FIG. 3).

Each gripper 40 is attached to an arm 47. The arms 47 are mounted, in turn, to a joint beam 48. The beam 48 is carried by at least two guide rails 49 displaceable in the machine frame 6. In order to displace the guide rails 49, arms 51 attached to a shaft 50 are coupled via push rods 52 with the guide rails 49. At least one pressure medium motor (dual-acting, not shown) is provided for rotating the shaft 50, this motor engaging at one of the arms 51, for example.

Each guide rail 49 is guided by three rollers 53, 54, 55 supported in the machine frame 6 to be mutually offset in the direction of the guide rail 49. In the illustrated embodiment, the roller 53 located in the closer proximity to the beam 48 for the grippers 40 is supported fixedly but freely rotatably in the machine frame 6 whereas the rollers 54 and 55 farther remote from the beam 48 can be adjusted upwards and downwards in the machine frame 6. It is thus possible to lower the grippers 40 at the end of the feeding motion, i.e. when the grippers 40 have moved a hollow profile strip up to the supports 7, by lifting the rollers 54, 55. In this way, the hollow profile strip can be inserted by the grippers 40 from above in the supports 7 after the grippers 40 have moved the hollow profile strip past below the bottom rim 8 of the supporting wall 1.

In the illustrated embodiment, the movable rollers 55 contacting the guide rails 49 From above are supported to be freely rotatable on arms 57 projecting from an operating shaft 56. The operating shaft 56 is supported in the machine frame 6 with the aid of a piston-cylinder unit 60 to be pivotable about an axis 58 in parallel to the conveying direction (arrow 28). The freely rotatable rollers 54 in contact with the guide rails 49 from below are supported on piston rods of piston-cylinder units 61. The piston-cylinder units 61 are moved synchronously with the shaft 56 and/or they urge the rollers 54 resiliently against the guide rails 49.

In order to facilitate removal of a hollow profile strip from the conveyor track 20 constituted by the groups 23 of rollers 24, 25, 26, these rollers are lowered by pivoting the beam 29, to which the arms 27 carrying the rollers 24, 25, 26 are fastened, about the axis 31 in parallel to the conveying direction (arrow 28) so that a hollow profile strip, after having been seized by the grippers 40, is then held merely by the grippers 40 and further movement of the hollow profile strip during transfer of the latter into the supports 7 is not obstructed by the conveyor track 20.

For advancing the hollow profile strip, the end of which proximate to the bending head 2 is still located beside the latter, into the zero position which can be defined by a stop (not shown) and then further into the starting position wherein the strip assumes, with respect to the bending head 2, the position correct for the first bending or curving step, and for transporting the hollow profile strip between the bending steps as well as for advancing the hollow profile strip if the latter is to be made into a curve, a feeding gripper 70 is provided in the zone of the bottom rim 8 of the supporting wall 1. This feeding gripper, for the forward movement of a hollow profile strip, can be advanced in parallel to the conveying direction (in opposition to the arrow 28) and, during the idle stroke, can be moved back again, as is known from DE-OS 4,109,549. For measuring and controlling the feeding step, a path measuring device, especially an increment pickup coupled with the drive means of the gripper 70 can be provided, as described in DE-OS 4,109,549.

The feeding gripper 70 can have the structure depicted in FIG. 6. In this embodiment, the lower jaw 75 of the feeding gripper 70 is attached to a slide 76 guided along at least one guide rail (not shown) extending in parallel to the conveying direction (arrow 28). The upper jaw 77 is movably supported on the slide 76 by way of parallelogram guide arms 78. A dual-acting pressure medium motor 79 is included for operating the jaw 77. The movable jaw 77 can be moved away from the lower jaw 75 by the pressure medium motor 79 to such an extent that it does not interfere with the removal of a finished spacer frame.

A baffle 1' with a forwardly angled bottom rim 1'' (indicated in dashed lines in FIG. 2) can be provided at the zone of the bottom rim 8 of the supporting wall 1 lying, in FIG. 1, on the left-hand side of the bending head 2. This baffle 1' and its rim 1'' guide and/or support the free end of a hollow profile strip bent into a spacer frame.

The bending device can additionally be equipped with a supporting finger (not shown) adjustable in a slot in the supporting wall 1, as known from DE-U-87 05 796. This supporting finger can form the brace for already bent and/or curved sections of a hollow profile strip in contact with the supporting wall 1.

The above-described apparatus operates as follows:

A hollow profile strip is taken from the magazine 12 and pushed onto the conveyor track 20 by a conveyor associated with the magazine 12 which can be a gripper that is movable to and fro. When the corresponding length of hollow profile strip, optionally after joining several hollow profile strip sections into a longer unit, has been pushed onto the conveyor track 20 [also this feeding step can be measured and controlled by an increment pickup coupled with the feeding gripper or the other feeding device (see DE-OS 4,109,549)], the hollow profile strip is cut to length by the oscillating saw 21. The clamping jaws 42 of the gripper 40 will now close. The groups 23 of rollers 24, 25, 26 of the conveyor track 20 are lowered by pivoting their carrying beam 29 so that the hollow profile strip is then merely held by the grippers 40. The grippers 40 advance and place the hollow: profile strip into the supports 7 arranged in opposition to the bottom rim 8 of the supporting wall 1. In this connection, it is to be noted that such supports 7 are also arranged beside the supporting wall 1, in opposition to the conveyor track 20, in order to support the hollow profile strip over its entire length.

After the grippers 40 have deposited the hollow profile strip, they move back again into their starting position. The conveyor track 20 is pivoted back again into its starting position, and another hollow profile strip can be fed while the bending device is in operation in order to produce a spacer frame for an insulating glass pane from the hollow profile strip by bending and/or curving.

As soon as a spacer frame is finished it is withdrawn or moved away from the device by hand or by a delivery conveyor, and the subsequent hollow profile strip pushed onto the conveyor track 20 in the meantime is placed by the grippers 40 into the support 7 as mentioned above so that a further bending step can be performed.

It can be seen that, by virtue of the arrangement of the conveyor track 20 behind the supporting wall 1 in accordance with this invention, hollow profile strips can be made available while a bending process is carried out. This saves a considerable amount of time.

It is understood that the apparatus of this invention can also be combined with a roll-forming device, arranged beside the apparatus, for the production of hollow profile strips from metal bands; in this case, the magazine 12 and the apparatus 21 for connecting hollow profile strips can be omitted.

In summation, the invention can be represented, for example, as follows:

In an apparatus for bending hollow profile strips into spacer frames for insulating glass panes, comprising an inclined supporting wall 1, at the bottom rim 8 of which at least one bending head 2 is arranged, a conveyor track 20 for feeding hollow profile strips to be bent into spacer frames and a device 40 for transferring hollow profile strips from the conveyor track 20 into supports 7 in the zone of the bottom rim 8 of the supporting wall 1 are provided behind the supporting wall 1. Thereby, the space behind the supporting wall 1 is utilized and the front side of the apparatus remains vacant so that it is accessible for an operator without any danger and mounting space is saved.

What is claimed is:

1. Apparatus for the production of spacer frames for insulating glass panes from hollow profile strips, comprising an inclined supporting wall (1) for supporting said frames at least one bending head (2) at a bottom rim (8) of said wall (1), means defining a conveyor track (20) extending in parallel to the bottom rim (8) of the supporting wall (1) for feeding hollow profile strips to be bent into spacer frames, and a device (40) for transferring hollow profile strips from the conveyor track (20) onto supports (7) adjacent the bottom rim (8) of the supporting wall (1), the conveyor track (20) and the device (40) for transferring hollow profile strips from the conveyor track (20) onto said supports (7) being disposed behind the supporting wall (1), and means for raising the conveyor track (20) into a position wherein the track (20) is aligned with said device (40) to permit transfer of said strips to said device and for lowering the conveyor track out of alignment with said device (40) thereby to permit said device (40) to transfer said strips onto said supports (7) without obstruction by the conveyor track (20).

2. Apparatus according to claim 1, wherein the roller groups (23) are attached to a beam (29) mounted in the machine frame (6) to be pivotable about an axis (31) parallel to a conveying direction (arrow 28) of the strips.

3. Apparatus according to claim 2, wherein each roller group (23) is mounted on an arm (27) attached to the beam (29) pivotable on a frame (6) of the apparatus.

4. Apparatus according to claim 3, wherein the device for transferring hollow profile strips has several grippers (40) with clamps (42) for seizing a hollow profile strip, these grippers being mounted on a beam (48) movably supported on the frame (6).

5. Apparatus according to claim 4, wherein the grippers (40) are arranged between arms (27) of the conveyor track (20) carrying neighboring roller groups (23).

6. Apparatus according to claim 4, wherein the beam (48) for the grippers (40) is connected with two guide rails (49) guided on the frame (6) to be ;displaceable transversely to said conveying direction (arrow 28).

7. Apparatus according to claim 6, wherein the guide rails (49) are guided by rollers (53, 54, 55) engaging the guide rails (49) from above and from below.

8. Apparatus according to claim 7, wherein the rollers (53) engaging the guide rails (49) from below are mounted on the frame (6) to be rotatable about fixed axes, and closer to the beam (48) for the grippers (40) than the other rollers (54, 55).

9. Apparatus according to claim 7, wherein the rollers (54, 55) engaging the guide rails (49) from above and from below are adjustable relative to the machine frame (6) in a vertical direction and are mounted to be farther removed from the beam (48) for the grippers (40) than the remaining rollers (53), and the first-mentioned rollers (54, 55) can be adjusted simultaneously in upward and downward directions.

10. Apparatus according to claim 7, wherein both guide rails (49) are coupled, via push rods (52), with arms (51), and the arms (51), in turn, are attached to a shaft (50) that is rotatable in the frame (6) about an axis parallel to the conveying direction (arrow 28) of the strips.

11. Apparatus according to claim 7, wherein the vertically adjustable rollers (55) for the guide rails (49) contact the latter from above and are supported on arms (57) attached to a shaft (56) mounted in the frame (6) to be pivotable about an axis (58) parallel to the conveying direction (arrow 28) of the strips.

12. Apparatus according to claim 1, wherein the conveyor track (20) extends past a side of the supporting wall (1) lying in opposition to a side of the supporting wall (1) from which the hollow profile strips are fed.

13. Apparatus according to claim 1 wherein the supports (7) for hollow profile strips are provided in a region along the conveyor track (20).

14. Apparatus according to claim 1, wherein, for feeding a hollow profile strip lying on the supports (7) during the course of the production of spacer frames by bending the hollow profile strip, a feeding gripper (70) is provided which can be reciprocated parallel to the conveying direction (arrow 28) of the strips.

15. Apparatus according to claim 1, wherein the conveyor track (20)is adjacent a magazine (12) for hollow profile strips to be bent into spacer frames.

16. Apparatus according to claim 15, wherein a device (21) for joining hollow profile strips into longer sections is provided between the conveyor track (20) and the magazine (12).

17. Apparatus according to claim 16, wherein the joining device (21) is a welding unit.

18. Apparatus according to claim 16, wherein the joining device (21) is a device for inserting linear connectors into the hollow profile strips.

19. Apparatus according to claim 1, wherein a beginning of the conveyor track (20) lies, in a direction perpendicularly to the bottom rim (8) of the supporting wall (1), beside the bending head (2) associated with the bottom rim (8) of the supporting wall (1).

20. Apparatus according to claim 19, wherein the beginning of the conveyor track (20) lies downstream of the bending head (2), based on the direction (arrow 28) in which the hollow profile strips are fed.

21. Apparatus according to claim 1, further comprising, at the beginning of the conveyor track (20), a device (21) for cutting hollow profile strips to length.

22. Apparatus according to claim 1, wherein, for feeding a hollow profile strip to the conveyor track (20) and for measuring the length of the hollow profile strip pushed onto the conveyor track (20), a feeding device (80) engaging the hollow profile strip with frictional contact is provided, this device being coupled with a path measuring device.

23. Apparatus according to claim 22, wherein the feeding device (80) has two endless belts (81, 82) engaging the hollow profile strip from two mutually opposite sides.

24. Apparatus according to claim 23, wherein at least one of the belts (81, 82) is driven by a drive means.

25. Apparatus according to claim 22, wherein the feeding device (80) is provided between an undercut swing saw (21) and the delivery end of the magazine (12) and, respectively, the joining device (21).

26. Apparatus for the production of spacer frames for insulating glass panes from hollow profile strips, comprising an inclined supporting wall (1) for supporting said frames, at least one bending head (2) at a bottom rim (8) of said wall (1), means defining a conveyor track (20) extending in parallel to the bottom rim (8) of the supporting wall (1) for feeding hollow profile strips to be bent into spacer frames, and a device (40) for transferring hollow profile strips from the conveyor track (20) onto supports (7) adjacent the bottom rim (8) of the supporting wall (1), the conveyor track (20) and the device (40) for transferring hollow profile strips from the conveyor track (20) onto said supports (7) being disposed behind the supporting wall (1), wherein the conveyor track (20) is formed by several groups (23) of rollers (24, 25, 26), wherein each roller group (23) comprises two freely rotatable rollers (24, 25) supported to be freely rotatable about axes perpendicular to the supporting wall (1), and one roller (26) supported to be freely rotatable about an axis parallel to the supporting wall (1).

27. Apparatus for the production of spacer frames for insulating glass panes from hollow profile strips, comprising an inclined supporting wall (1) for supporting said frames, at least one bending head (2) at a bottom rim (8) of said wall (1), means defining a conveyor track (20) extending in parallel to the bottom rim (8) of the supporting wall (1) for feeding hollow profile strips to be bent into spacer frames, and a device (40) for transferring hollow profile strips from the conveyor track (20) onto supports (7) adjacent the bottom rim (8) of the supporting wall (1), the conveyor track (20) and the device (40) for transferring hollow profile strips from the conveyor track (20) onto said supports (7) being disposed behind the supporting wall (1), wherein the supports (7) for hollow profile strips are angular members having a leg (9) parallel to the plane (11) of the supporting wall (1) and in alignment with this plane (11), and a further leg (10) substantially perpendicular to said plane (11) and pointing in an upward direction.

* * * * *